United States Patent [19]

Oude Alink

[11] Patent Number: 4,490,293

[45] Date of Patent: Dec. 25, 1984

[54] 2,5,6,8,9-PENTA-ALKYL OR PENTA-ARALKYL-SUBSTITUTED 1,3,7-TRIAZABICYCLO(3,3,1) NON-3-ENES AND TRIALKYL OR TRIARALKYL-SUBSTITUTED TETRAHYDROPYRIMIDINES

[75] Inventor: Bernardus A. Oude Alink, St. Louis, Mo.

[73] Assignee: Petrolite Corporation, St. Louis, Mo.

[21] Appl. No.: 454,940

[22] Filed: Jan. 3, 1983

Related U.S. Application Data

[63] Continuation-in-part of Ser. No. 404,007, Aug. 2, 1982, abandoned, which is a continuation of Ser. No. 932,088, Aug. 7, 1978, abandoned.

[51] Int. Cl.[3] ..... C07D 487/18; C07D 251/00; C07D 239/70

[52] U.S. Cl. ..... 260/243.3; 544/180; 544/242; 544/282

[58] Field of Search ..... 544/242, 282, 180; 260/243.3

[56] References Cited

U.S. PATENT DOCUMENTS

| | | | |
|---|---|---|---|
| 2,516,626 | 7/1950 | Haury | 544/242 |
| 2,525,855 | 10/1950 | Bergmann | 544/231 |
| 2,534,828 | 12/1950 | Mitchell et al. | 544/242 |
| 3,916,994 | 12/1975 | White et al. | 166/271 |
| 4,258,186 | 3/1981 | Schott et al. | 544/242 |

OTHER PUBLICATIONS

J. Org. Chem. vol. 38, No. 19, 1973, Nielsen et al. pp. 3288–3295.

Organic Chemistry, Morrison & Boyd, 1966, p. 23.

D. J. Brown "The Pyrimidines" pp. 448 and 449, 1962 Interscience Publishers, N. Y., London.

Feiser et al., Advanced Organic Chemistry pp. 7 and 9, 1961 Reinhold Publishing Co., N. Y.

*Primary Examiner*—Nicholas S. Rizzo
*Assistant Examiner*—Cecilia Shen
*Attorney, Agent, or Firm*—Sidney B. Ring; Leon Zitver

[57] ABSTRACT

This invention relates to the preparation of penta-alkyl (or aralkyl)-substituted 1,3,7-triazabicyclo (3,3,1) non-3-enes (TBN's) and trialkyl (or aralkyl)-substituted tetrahydropyrimidines (THP's) by reacting trialkyl (or aralkyl)-hexahydrotriazines and/or N,N'-dialkylidene 1,1-diamino alkanes in the presence of a Lewis acid; and to the products thereof.

13 Claims, No Drawings

2,5,6,8,9-PENTA-ALKYL OR PENTA-ARALKYL-SUBSTITUTED 1,3,7-TRIAZABICYCLO(3,3,1) NON-3-ENES AND TRIALKYL OR TRIARALKYL-SUBSTITUTED TETRAHYDROPYRIMIDINES

This application is a continuation-in-part of Ser. No. 404,007, filed Aug. 2, 1982, now abandoned, which was a continuation of Ser. No. 932,088, filed Aug. 8, 1978, now abandoned.

In J. Org. Chem. Vol. 38 No. 19, 1973, p. 3288, Nielsen, et al. describe the following reactions:

(1) The reaction of an aldehyde with ammonia to yield 2,4,6-trialkyl-1,3,5-hexahydrotriazines (Formula I) in accord with the equation Formula I

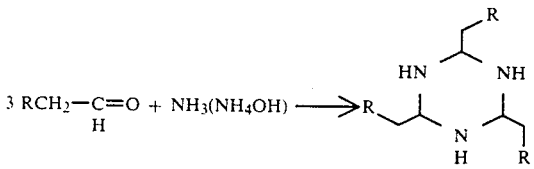

(2) The deammoniation of Formula I to yield N,N'-dialkylidene 1,1-diaminoalkane (Formula II) in accord with the equation Formula II

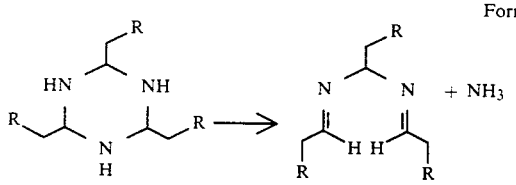

I have now discovered that N,N'-dialkylidene 1,1-diaminoalkanes can be reacted in the presence of a Lewis acid to form 2,5,6,8,9-penta-alkyl (or aralkyl)-substituted 1,3,7-triazabicyclo (3,3,1) non-3-enes's (TBN's), or mixtures thereof, according to the equation:

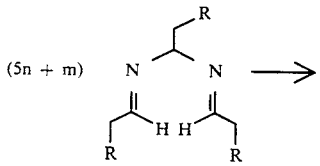

N,N'—dialkylidene 1,1-diaminoalkane

-continued

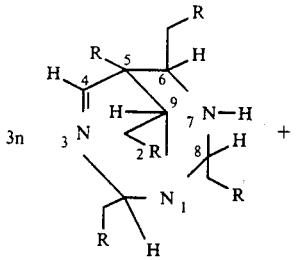

Formula III 2,5,6,8,9-Penta alkyl (or aralkyl) substituted 1,3,7-triazabicyclo (3,3,1) non-3-ene (TBN)

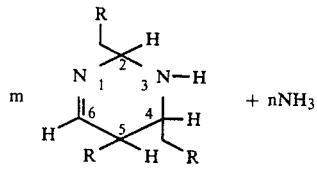

Formula IV 2,4,5,-Trialkyl (or aralkyl) substituted tetrahydropyrimidine (THP)

I have also discovered that it is not necessary to isolate the N,N'-dialkylidene 1,1-diamino alkane. The reaction can be carried out in one step by heating the 2,4,6-Trialkyl (or aralkyl) 1,3,5-hexahydrotriazine in the presence of a Lewis acid until conversion to the TBN and/or THP is effected.

Although reaction conditions such as time, temperature, solvent (if employed), etc., can vary widely, the preferred conditions will depend on various factors such as the particular reactants, the particular Lewis acid, the interrelationship of conditions, etc. Thus, any suitable reaction time, temperature, solvent, Lewis acid, etc., can be employed provided the desired products are produced.

Reaction conditions required to convert the 2,4,6-Trialkyl 1,3,5-hexahydrotriazine to TBN and/or THP, or to convert the N,N'-dialkylidene 1,1-diamino alkane to TBN and/or THP may be summarized as follows:

Temperature: From about 30°–150° C., such as from about 40°–120° C., but preferably from about 50°–100° C.

Time: From about 0.5–48 hours such as from about 1–24 hours, but preferably from about 1–18 hours.

Solvent: The reaction can be carried out with or without a solvent. If a solvent is used, any solvent can be used as long as it does not interfere with the reactants, for example, aliphatic hydrocarbons such as pentanes, hexanes, etc.; aromatic solvents such as benzene, toluene, xylenes, etc.; alcohols such as methanol, ethanol, i-propanol, etc.

Catalyst: Any suitable Lewis acid can be employed such as $AlCl_3$, $ZnCl_2$, $FeCl_3$, $BF_3$, $SnCl_4$, $NH_4I$, $NH_4Br$, $NH_4Cl$, $NH_4$ acetate, etc. A weak Lewis acid is preferred such as ammonium chloride, ammonium acetate, etc.

R Group: Any suitable aldehyde can be employed such as alkyl, etc., but preferably linear alkyl aldehydes. The reaction can also be effected with other aldehydes, preferably where a second methylene to the aldehyde group is present, i.e.,

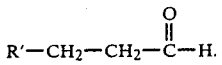

including aralkyl, etc. groups.

Thus, alkyl groups having from about 1 to 30 carbons such as from about 1–18 carbons, for example from about 1–12 carbons, but preferably lower alkyls having from about 1–8 carbons, can be employed.

Yields: They are substantially quantitative for conversion to TBN and/or THP.

The 2,5,6,8,9-Penta-alkyl (or aralkyl)-substituted 1,3,7-triazabicyclo (3,3,1) non-3-ene derived from a simple aldehyde may exist as any of 16 possible stereo-isomers. The following two stereo-isomers were identified:

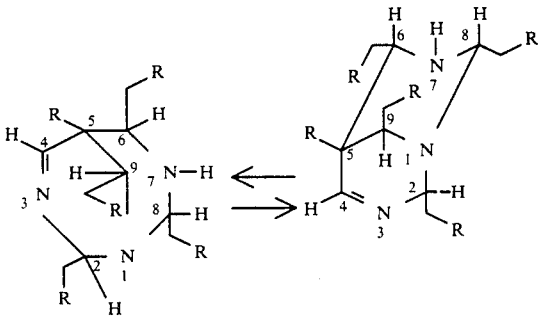

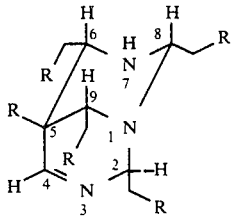

The difference between the two isomers is in the attachment of the 9—$CH_2$—R group.

The following examples are presented by way of illustration and not of limitation.

EXAMPLE 1

5-Methyl-2,6,8,9-tetraethyl-1,3,7-triazabicyclo (3,3,1) non-3-ene

A sample of 1330 cc of 28% ammonium hydroxide was cooled to 2° C. Over a 2 hours period 290 grams of propionaldehyde was added, while a reaction temperature of 0°–10° C. was maintained. The resulting solution was kept for 4 days at about 5° C., after which time 400 grams of sodium chloride was added. The product was extracted three times with ether, and the ethereal solution after drying over anh. $MgSO_4$ evaporated under diminished pressure to yield 119 grams of 2,4,6-triethyl 1,3,5-hexahydrotriazine. $^{13}C$ nuclear magnetic resonance spectrum, solvent $CDCl_3$, internal reference tetramethylsilane, δ in ppm:

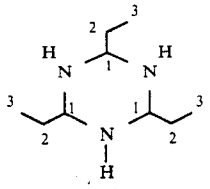

71.8 (1); 29.8 (2); 9.4 (3).

A mixture of 117 grams of 2,4,6-triethyl 1,3,5-hexahydrotriazine, 117 grams of hexanes (b.p. 65.8°–67.8° C.) and 1.5 grams of ammonium chloride was refluxed under azeotropical conditions for 5 hours. Ammonia gas was evolved during the reaction. The reaction mixture after cooling to ambient temperature was concentrated under diminished pressure to yield 97 grams of product. A sample of 16 grams of the product was distilled under diminished pressure from 3 pellets of sodium hydroxide, and the fraction 11.5 grams of b.p. 83°–86° C./0.06 torr was identified as a mixture of two stereoisomers of 5-methyl-2,6,8,9-tetraethyl 1,3,7-triazabicyclo (3,3,1) non-3-ene. Anal. Calculated for $C_{15}H_{29}N_3$: N, 16.73%; Found: N, 16.69%. Upon standing, the isomer with the 9-ethyl group in the axial position with respect to the hexahydropyrimidine ring crystallized from the mixture, m.p. 74°–76° C.; Infrared spectrum, KBr pellet, 3.08μ (N—H) and 6.08μ (C=N); $^1H$ nuclear magnetic resonance spectrum, solvent $CDCl_3$, internal reference tetramethylsilane. δ in ppm: 7.58, d, 1H; 4.45, m, 1H; 3.67, ε, 1H; 2.90–2.40 m's, 2H; 1.92–1.13 m's, 8H; 1.13–0.60 m's, 15H. $^{13}C$ nuclear magnetic resonance spectrum, solvent $CDCl_3$, internal reference tetramethylsilane, δ in ppm:

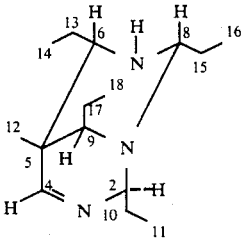

68.7 (2); 167.8 (4); 37.4 (5); 60.5 (6); 74.2 (8); 57.8 (9); 23.6 (10); 10.9 (11); 19.9 (12); 27.9 (13); 11.6 (14); 26.5 (16); 16.8 (17); 12.1 (18).

Anal. Calculated for $C_{15}H_{29}N_3$; C, 71.71; H, 11.55; N, 16.73. Found: C, 71.62; H, 11.63; N, 16.58.

The other isomer was identified as having a 9-ethyl group in the equatorial position, with respect to the hexahydropyrimidine ring. $^{13}C$ nuclear, magnetic resonance spectrum, solvent $CDCl_3$, internal reference tetramethylsilane, δ in ppm:

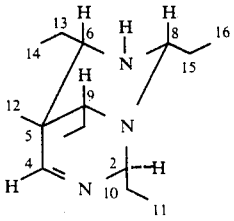

73.0 (2); 165.3 (4); 38.5 (5); 67.1 (6); 80.7 (8); 68.4 (9); 30.4 (10); 11.4 (11); 18.2 (12); 27.8 (13); 11.7 (14); 24.0 (15); 10.5 (16); 22.6 (17); 12.6 (18).

EXAMPLE 2

5-Ethyl-2,6,8,9-tetrapropyl 1,3,7-triazabicyclo (3,3,1) non-3-ene

To a sample of 606 grams of 28% ammonium hydroxide was added over a 1 hour period 321 grams of butyraldehyde at a reaction temperature of 25°–29° C. After the addition was completed, the mixture was stirred for 2 more hours at ambient temperature. The organic layer was separated and dissolved in hexanes. The hexane solution after drying over anh. $MgSO_4$, was evaporated under diminished pressure to yield 278.8 grams of 2,4,6-tripropyl 1,3,5-hexahydrotriazine, $^{13}C$ nuclear magnetic resonance spectrum, solvent $CDCl_3$, internal reference tetramethylsilane, δ in ppm:

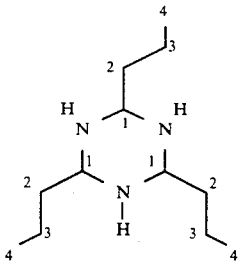

70.3 (1); 39.5 (2); 18.4 (3); 14.2 (14)

A mixture of 146.4 grams of 2,4,6-tripropyl 1,3,5-hexahydrotriazine and 267 grams of hexanes was refluxed under azeotropical conditions for 19 hours. The hexanes were removed under diminished pressure to yield 121.6 grams of N,N'-dibutylidene-1,1-diaminobutane, $^{13}C$ nuclear magnetic resonance spectrum, solvent $CDCl_3$, internal reference tetramethylsilane, δ in ppm:

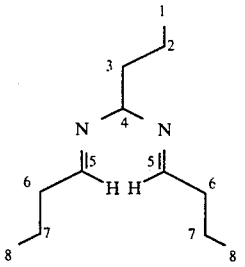

13.8 (1); 18.6 (2); 40.0 (3); 91.3 (4); 163.5 (5); 38.0 (6); 19.5 (7); 14.1 (8).

A mixture of 120 grams of N,N'-dibutylidene 1,1-diaminobutane, 1.3 grams of acetic acid and 158 grams of hexanes (b.p. 65.8°–67.8° C.) was refluxed for 1 hour. The hexanes were removed under diminished pressure to yield 118 grams of a mixture of 20% 2,4-dipropyl 5-ethyl 2,3,4,5-tetrahydropyrimidine, $^{13}C$ nuclear magnetic resonance spectrum, solvent $CDCl_3$, internal reference tetramethylsilane,

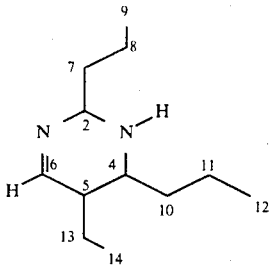

72.9 (2); 53.5 (4); 44.6 (5); 164.1 (6); 39.8 (7); 18.8 (8); 14.2 (9); 36.7 (10); 19.2 (11); 14.2 (12); 22.5 (13); 10.5 (14).

15% of 5-ethyl 2,6,8,9-tetrapropyl 1,3,7-triazabicyclo (3,3,1) non-3-ene, with the 9 ethyl group in the equatorial position, with respect to the hexahydropyrimidine ring and 65% of 5-ethyl 2,6,8,9-tetrapropyl 1,3,7-triazabicyclo (3,3,1) non-3-ene with the 9 ethyl group in the axial position with respect to the hexahydropyrimidine ring. Infrared spectrum, 3.05μ (N—H) and 6.05μ (C=N), 'H nuclear magnetic resonance spectrum, solvent $CDCl_3$, internal reference tetramethylsilane, δ in ppm: 7.57, 1H; 4.54, 1H; 3.78, 1H; 2.98 and 2.84, 2H; 1.1–2.2, 18H; and 0.95, 15H. $^{13}C$ nuclear magnetic resonance spectrum, solvent $CDCl_3$, internal reference tetramethylsilane, δ in ppm:

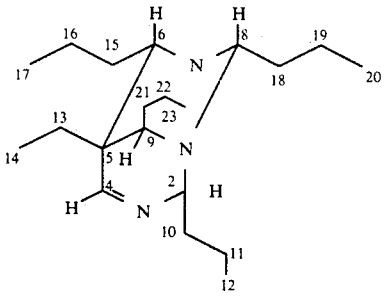

66.9 (2); 167.6 (4); 40.2 (5); 50.3 (6); 72.5 (8); 58.0 (9); 32.5 (10); 19.6 (11); 14.2 (12); 25.0 (13); 8.1 (14); 37.4 (15); 20.0 (16); 14.2 (17); 36.0 (18); 18.5 (19); 14.2 (20); 25.5 (21); 20.3 (22); 14.2 (23).

EXAMPLE 3

5-Propyl 2,6,8,9-tetrabutyl 1,3,7-triazabicyclo (3,3,1) non-3-ene

To a sample of 560 cc of 28% ammonium hydroxide was added with stirring 179 grams of valeraldehyde over 1½ hours while a reaction temperature of 20°–42° C. was maintained. Stirring was continued for 2 hours at ambient temperature. The organic layer which separated was taken up in hexanes and the hexane solution after drying over sodium hydroxide was evaporated under diminished pressure to yield 169.5 grams of 2,4,6-tributyl 1,3,5-hexahydrotriazine. $^{13}C$ nuclear magnetic resonance spectrum, solvent $CDCl_3$, internal reference tetramethylsilane, δ in ppm:

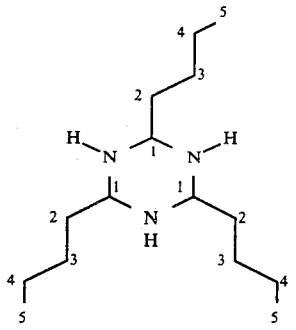

70.5 (1); 37.0 (2); 27.3 (3); 22.7 (4); 13.9 (5).

A mixture of 168.8 grams of 2,4,6-tributyl 1,3,5-hexahydrotriazine, 228 grams of hexanes, and 1.5 grams of ammonium chloride were refluxed for 2 hours. A sample of 3 grams of solution was removed to determine the $^{13}C$ nuclear magnetic resonance spectral characteristics of the product. After 2 hours reaction the product was identified as mainly N,N'-dipentylidene 1,1-diaminopentane. $^{13}C$ nuclear magnetic resonance spectrum, solvent $CDCl_3$, internal reference tetramethylsilane, δ in ppm:

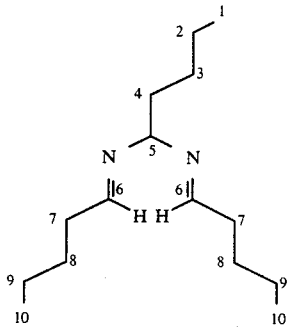

14.2 (1); 22.5 (2); 27.7 (3); 37.4 (4); 91.4 (5); 163.5 (6); 35.7 (7); 28.3 (8); 22.9 (9); 14.2 (10).

Reflux of the remaining hexane solution was continued for 17 hours. The solution was filtered and the solvent removed under diminished pressure to yield 157 grams of a mixture of 20% 2,4-dibutyl 5-propyl 2,3,4,5-tetrahydropyrimidine, 10% of 5-propyl-2,6,8,9-tetrabutyl 1,3,7-triazabicyclo (3,3,1) non-3-ene, the isomer with the 9 butyl group in the equatorial position with respect to the hexahydropyrimidine, and 70% of 5-propyl 2,6,8,9-tetrabutyl 1,3,7-triazabicyclo (3,3,1) non-3-ene, the isomer with the 9 butyl group in the axial position. Infrared spectrum, 3.04μ (N—H) and 6.04μ (C=N). $^{13}C$ nuclear magnetic resonance spectrum, solvent $CDCl_3$, internal reference tetramethylsilane, δ in ppm:

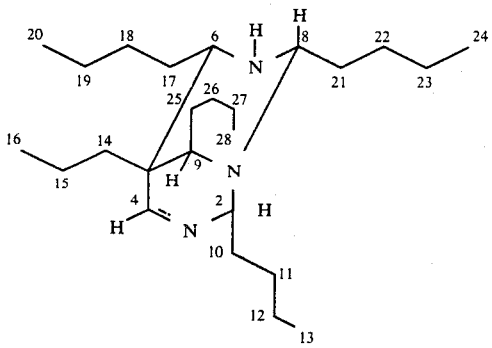

67.0 (2); 167.5 (4); 40.3 (5); 51.2 (6); 72.6 (8); 58.2 (9); 30.0 (10); 28.6 (11); 22.7 (12); 14.0 (13); 34.8 (14); 17.0 (15); 14.9 (16); 35.1 (17); 29.1 (18); 22.7 (19); 14.0 (20); 33.5 (21); 27.5 (22); 22.7 (23); 14.0 (24); 22.3 (25); 29.6 (26); 22.7 (27); 14.0 (28).

The products of this invention have a wide variety of uses. For example, they can be employed as corrosion inhibitors, biocides, fuel additives, etc.

Corrosion Test: $CO_2$ Wheel Test

Corrosion tests are carried out with coupons (140×12×1 mm) of mild steel stored under nitrogen and made grease-free with hexane.

In the test, 250 ml bottles are filled with 100 ml of kerosene or condensate from a well, 100 ml of a 3% NaCl solution in distilled water and 100 ppm of inhibitor in hydrocarbon phase. The bottles are then placed in a water bath to heat them to 60° C. The fluids are saturated with carbon dioxide for 30 minutes using individual spargers in each bottle. The coupons are then inserted and the bottles immediately closed.

The bottles are placed on the corrosion wheel apparatus and rotated end over end at 40 rev/min at 80° C. in a thermostatically controlled cabinet.

After the test period the coupons are washed with ethanol and hexane and then immersed for one minute in stirred Clarke's solution (inhibited hydrochloric acid). They are then immediately neutralized with sodium bicarbonate solution, rinsed with water, dried and weighed. The mean weight loss and corrosion protection data is then calculated.

TABLE 1

Corrosion Test Data at 100 ppm Inhibitor Concentration and 24 Hours Test Period

| Compounds | Weight Loss, grams | % Protection |
|---|---|---|
| No additive | 0.0423 | 0 |
| 5-Methyl-2,6,8,9-tetramethyl-1,3,7-triazabicyclo (3,3,1) non-3-ene | 0.0074 | 82.5 |
| 5-Ethyl-2,6,8,9-tetrapropyl-1,3,7 triazabicyclo (3,3,1) non-3-ene | 0.0069 | 83.7 |
| 5-Propyl-2,6,8,9-tetrabutyl-1,3,7-triazabicyclo (3,3,1) non-3-ene | 0.0079 | 81.3 |

I claim:

1. A process of preparing a mixture of penta-alkyl or penta-aralkyl-substituted 1,3,7-triazabicyclo (3,3,1) non-3-enes of the formula formula III

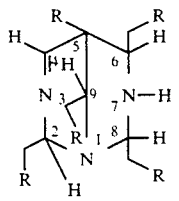

which comprises reacting a compound of the formula formula II

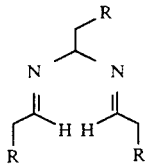

at a temperature of about 30° C. to about 150° C. for a period of about 0.5 to about 48 hours in the presence of a Lewis acid selected from the group consisting of $AlCl_3$, $ZnCl_2$, $FeCl_3$, $BF_3$, $SnCl_4$, $NH_4I$, $NH_4Br$, $NH_4Cl$, $NH_4$acetate and acetic acid, where R is alkyl or aralkyl having up to 30 carbon atoms.

2. The process of claim 1 where R is lower alkyl.

3. The product obtained by the process of claim 1.

4. The product obtained by the process of claim 2.

5. The process of claim 1 where the reactant of formula II is N,N'-dibutylidene-1,1-diamino butane, and the product obtained is a mixture of 2,4-dipropyl 5-ethyl 2,3,4,5-tetrahydropyrimidine and 5-ethyl 2,6,8,9-tetrapropyl 1,3,7-triazabicyclo (3,3,1) non-3-ene.

6. The product obtained by the process of claim 5.

7. A process for preparing penta-alkyl or penta-aralkyl substituted 1,3,7-triazabicyclo (3,3,1) non-3-enes of the formula formula III

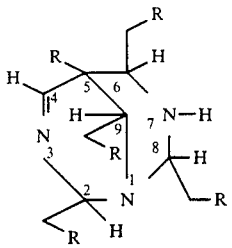

where R is alkyl or aralkyl having up to 30 carbon atoms, and where a compound of the formula formula II

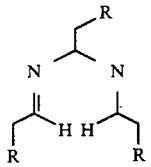

is produced in situ, which comprises reacting trialkyl or triaralkyl hexahydrotriazine in the presence of a non-interfering solvent at a temperature of about 30° C. to about 150° C. in the presence of a Lewis acid selected from the group consisting of $AlCl_3$, $ZnCl_2$, $FeCl_3$, $BF_3$, $SnCl_4$, $NH_4I$, $NH_4Br$, $NH_4Cl$, $NH_4$acetate and acetic acid for about 0.5 to about 48 hours until the formula III product is produced.

8. The process of claim 7 where the reactant is 2,4,6-triethyl 1,3,5-hexahydrotriazine and the product obtained is 5-methyl-2,6,8,9-tetraethyl-1,3,7-triazabicyclo (3,3,1) non-3-ene.

9. The process of claim 8 where the solvent is hexane, the Lewis acid is ammonium chloride and the reaction is carried out at a reflux temperature for a period of about 5 hours.

10. The product obtained by the process of claim 9.

11. The process of claim 7 where the reactant is 2,4,6-tributyl 1,3,5-hexahydrotriazine, N,N'-dipentylidene 1,1-diaminopentane is produced in situ, and the product obtained is a mixture of 2,4-dibutyl 5-propyl 2,3,4,5-tetrahydropyrimidine and 5-propyl-2,6,8,9-tetrabutyl 1,3,7-triazabicyclo (3,3,1) non-3-ene.

12. The process of claim 11 where the solvent is hexane, the Lewis acid is ammonium chloride, and the reaction is carried out at reflux temperature.

13. The product obtained by the process of claim 12.

* * * * *